US006533140B1

(12) United States Patent
Freeman

(10) Patent No.: US 6,533,140 B1
(45) Date of Patent: Mar. 18, 2003

(54) BEVERAGE CONTAINER HOLDER

(76) Inventor: William C Freeman, 5701 N. Sheridan Rd., #24M, Chicago, IL (US) 60660

( * ) Notice: Subject to any disclaimer, the term of this patent is extended or adjusted under 35 U.S.C. 154(b) by 0 days.

(21) Appl. No.: 09/713,511

(22) Filed: Nov. 15, 2000

(51) Int. Cl.[7] ..... B65D 25/00
(52) U.S. Cl. ..... 220/737; 220/475
(58) Field of Search ..... 220/737, 475; 248/530, 156

(56) References Cited

U.S. PATENT DOCUMENTS 1,326,086 A * 12/1919 Ormandy ..... 220/475 X
2,673,053 A * 3/1954 Kilian ..... 220/475 X
6,123,220 A * 9/2000 Williams ..... 220/737

* cited by examiner

*Primary Examiner*—Steven Pollard
(74) *Attorney, Agent, or Firm*—Cook, Alex, McFarron, Manzo, Cummings & Mehler, Ltd.

(57) ABSTRACT

A beverage container holder includes a first portion for securing the holder to the ground and a second portion defining an area for placement of a beverage container such as a can or bottle. The first portion is configured for insertion into the ground and may be spiked, pronged, or otherwise characterized for piercing the earth. The second portion is connected to the first portion and includes a surface upon which the container may be placed. The second portion also includes structure for preventing the container from falling or tipping off of the surface.

20 Claims, 1 Drawing Sheet

BEVERAGE CONTAINER HOLDER

BACKGROUND OF THE INVENTION

The present invention relates generally to beverage container holders, and more particularly, to portable beverage container holders having vertical supports that are adapted to be implanted into the ground such that the holder retains its associated beverage container in a raised, yet low-standing, relationship to the ground.

According to statistics determined by several of the States, it is estimated that over one hundred thirty million (130,000,000) visits are made to beaches and parks each year. Additionally, there are about one hundred thirty-five (135) major ampitheaters, bandshells, pavilions, music parks and other forms of outdoor-concert venues, all of which have capacities that permit them to seat crowds of four thousand (4,000) to twenty thousand (20,000) patrons.

Given the above, and given the fact that most outings to these locations typically last for at least one, and more likely several, hours, patrons typically consume cool beverages during such outings, particularly on hot summer days. Up until the present invention, at such outings, patrons were required to either hold their beverages, or set them at rest against the ground surface. As an alternative, some patrons placed their beverage containers in a makeshift burrow dug into the ground surface. Others rested them in the fold of a towel, shirt or similar cloth.

As will be appreciated, any of the above prior art solutions were inadequate for at least two reasons. First, beverage containers typically have an outside surface that permits the accumulation of sand, especially when the container surface is moist due to condensation. When a person lifts the container from its rested position, the accumulated sand often falls from the beverage container onto the clothing and other items of the person or sticks to the person's hand. Second, while resting on the ground or set in any of the other above-described manners, the beverage container is typically not supported in a way such that it will remain upright when subjected to even relatively minor external forces.

In light of the foregoing deficiencies in what has been attempted before to resolve this age-old problem, it is an object of the preferred form of the present invention to provide a beverage container holder that permits a beverage container to rest on a platform raised above the ground.

It is another object of the preferred form of the present invention to provide a beverage container holder that permits a beverage container to rest in a low-standing relationship to the ground.

It is yet another object of the preferred form of the present invention to provide a beverage container holder that is portable.

It is still another object of the preferred form of the present invention to provide a beverage container holder that includes vertical supports that are adapted such that a portion of each of them can be firmly implanted into the ground and the holder can retain the beverage container in a stable, upright position.

It is still yet another object of the preferred form of the present invention to provide a beverage container holder that includes a hedge that prevents an associated beverage container, once retained in the cannister placement area of the holder, from spilling its liquid contents.

It is another object of the preferred form of the present invention to provide a beverage container holder that can be nested within a beverage container holder of identical size, thereby permitting a plurality of such beverage container holders of identical size to form a stack of such beverage container holders.

These and other objects of the preferred form of the present invention will become apparent from the following description. It will be understood, however, that an apparatus could still appropriate the invention claimed herein without accomplishing each and every one of these objects, including those gleaned from the following description. The appended claims, not the objects, define the subject matter of this invention. Any and all objects are derived from the preferred form of the invention, not necessarily the invention in general.

SUMMARY OF THE INVENTION

The present invention is directed to a beverage container holder comprising a vertical support system portion that has at least a section thereof that can be inserted into the ground. The beverage container holder further includes a canister placement area defined by a base portion connected to the vertical support system portion for supporting the beverage container above the ground when the vertical support system portion section is inserted into the ground. The beverage container holder cannister placement area is further defined by a hedge portion. The hedge portion maintains the beverage container in a substantially upright position when the container is placed within the cannister placement area, and thereby prevents the liquid contents of the beverage container from spilling on the ground or elsewhere.

BRIEF DESCRIPTION OF THE DRAWINGS

In describing the preferred form of the present invention, reference is made to accompanying drawings wherein like reference numerals identify like parts, and wherein.

DETAILED DESCRIPTION OF THE PREFERRED EMBODIMENT

Figure 1:
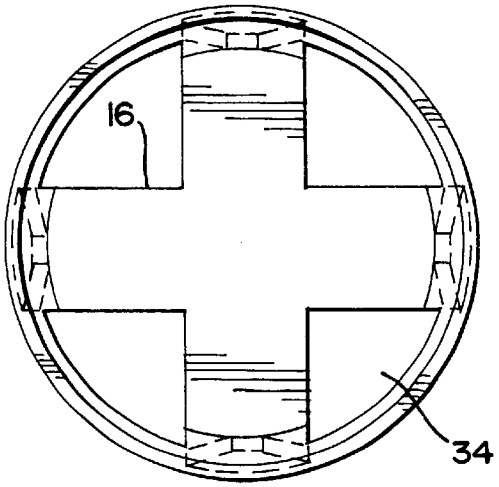
FIG. 1 is a top plan view of the preferred embodiment of the beverage container holder of the present invention.
Figure 3:
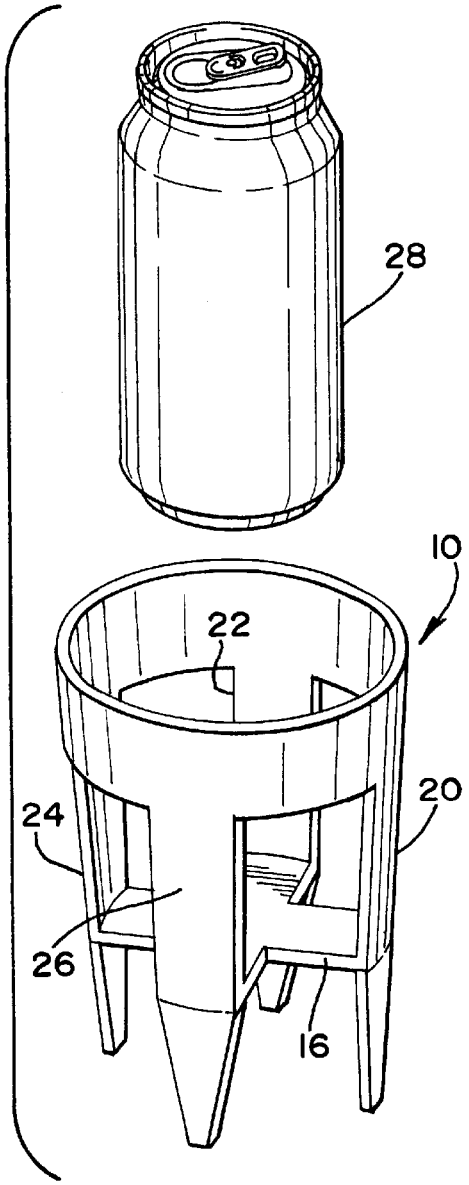
FIG. 3 is an exploded perspective view of the embodiment of FIG. 1 shown relative to an exemplary beverage container.
Figure 2:
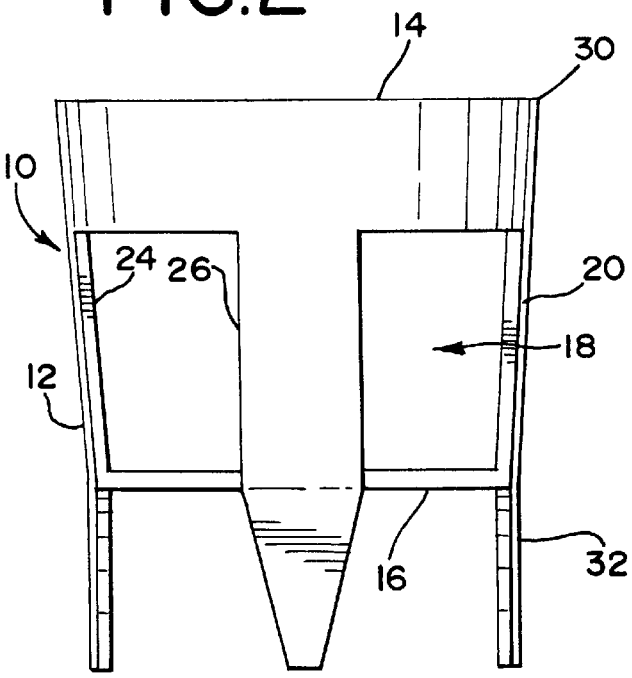
FIG. 2 is a side elevational view of the beverage container holder shown in FIG. 1.

FIGS. 1–3 illustrate a beverage container holder 10 that includes a vertical support system portion 12, a hedge portion 14, and a base portion 16. As illustrated, the hedge 14 preferably circumscribes the top of the beverage holder 10 and, together with the vertical support system 12 and base 16, outlines a beverage canister placement volume 18 for supporting and maintaining a beverage container in a substantially upright position.

The vertical support system 12 functions to stabilize the beverage holder 10 and receive a portion of a beverage container (e.g., can 28). Vertical support system 12 can also support other structure configured for holding a beverage container, such as insulating beverage wraps and the like. Vertical support system 12 includes legs 19 having tapering edges. Legs 19 are designed to penetrate a variety of natural ground surfaces, such soil, sand, or other earthly medium. Legs 19 are inserted into the ground to immobilize and thereby stabilize the beverage container holder 10 and maintain the beverage container in a substantially upright position.

In the illustrated embodiment, vertical support system 12 includes four upstanding supports 20, 22, 24, and 26, each having a leg 19. The vertical support system 12 can include any number of supports sufficient to anchor the beverage holder. As explained below, the vertical support system may comprise other configurations, such as a continuous conical section.

The upstanding supports 20, 22, 24, 26 of the illustrated, preferred embodiment have a rectangular segment forming a portion of the cannister support area 18 and a triangular or pointed segment defining legs 19 for piercing the ground. Preferably, the rectangular and triangular segments are integrally formed in a single molding or casting. However, they may be formed or cut separately and attached via screws, weld, or other attaching mechanism known in the art, and therefore the present invention should not be limited thereby.

In the illustrated embodiment, the hedge 14 is in the form of a looped band circumscribing the upper portion of the canister placement area 18. Alternatively, hedge 14 could be in the form of a triangle, square, or other polygon. A number of unconnected segments could also form the hedge, each extending horizontally from its respective upstanding support. Regardless of the specific form it may take, the function of the hedge is to maintain the beverage container in a substantially upright position so as to prevent it from tipping over and causing the liquid contents contained therein to be spilled on the ground or elsewhere.

In the illustrated embodiment, the base 16 is coincident with the rectangular segment and pointed segment junction for each upstanding support 20, 22, 24, 26. As shown in FIG. 1, the preferred base 16 is in the shape of a cross. Preferably, the base is constructed of two sections of orthogonally disposed plastic molding positioned coincident with the center of beverage container holder 10. Preferably, the sections of base 16 are intermeshed, forming one unified piece. As such, they can be constructed by a single molding or casting, as the case may be.

When in use, the beverage container (e.g., can 28) preferably rests against base 16 in an upright position. Preferably, base 16 is spaced from, yet relatively close to, the ground surface when the beverage container supports are partially inserted into the ground. It will be appreciated that base 16 can be any shape or configuration suitable for supporting a beverage container. For example, the base can be constructed of a plurality of parallel thin strips, intersecting strips, a solid disk, a disk with a plurality of holes or slits, or any other suitable configuration.

FIG. 3 shows a beverage container in the form of a can 28 prior to placement in the canister support area 18 of the beverage container holder 10. In the illustrated embodiment, the canister support area 18 is dimensioned so that a standard-dimensioned one or two serving can, cup, bottle or other container fits in the canister support area and rests on the base 16. The preferred dimensions of the beverage container holder are:

height: 4¾ inches looped band: diameter—4 inches (outside), 3¾ inches (inside); thickness ⅛ to ¼ inch base sections: width—1 inch.

In the preferred embodiment, the beverage container holder is constructed entirely of plastic and formed from a mold so that the beverage container holder is a single unified device. Alternatively, the base, hedge, and vertical support system can be molded separately or cut from a plastic sheet and glued or attached thermodynamically or by any other suitable manner known in the art. In the illustrated embodiment, the thickness of the plastic is uniform, at about ⅛ inch.

Alternatively, the beverage holder may be constructed out of cardboard (preferably nonabsorbent), metal, wood, glass, or other material having a rigidity sufficient to penetrate the ground (for the piercing portion of the vertical support system) and maintain a beverage container in a substantially upright position. Also, different portions of the beverage container holder may be constructed from different materials. For example, the ground piercing portion may be constructed out of aluminum or other metal and the remainder of the device may be constructed from a soft plastic.

A further feature of the illustrated embodiment is that multiple beverage container holders may be conveniently stored, transported, and/or displayed together. Referring again to FIG. 2, the hedge 14 and upstanding supports 20, 22, 24, and 26 are tapered radially inwardly from the top 30 to the base 16. This configuration allows the bottom of one beverage container holder to fit through the top of another beverage container holder for advantageously stacking multiple units. Further, the legs 19 of the upstanding supports do not continue to taper inward but remain vertical. Because the legs 19 of the upstanding supports of the illustrated embodiment are triangular, as explained above, and the base 16 includes gaps 34 (FIG. 1) a stack of multiple container holders can be advantageously compressed for storage, transportation, display and/or other reasons. The compression/stacking feature is not limited to the configuration of the illustrated embodiment, but can also be obtained with various other configurations.

Several further embodiments of a beverage container holder of the present invention will now be discussed. In a first further embodiment, the upstanding supports are circular, preferably of a small diameter such as ¼ inch. Such upstanding supports may be of a greater diameter, but preferably hollow to allow easy penetration into the ground.

In a second further embodiment, the beverage container holder includes a ground stop portion generally parallel and spaced away from the base portion. The ground stop portion is positioned below the base portion to bear against the ground when the beverage container holder supports are partially inserted into the ground. In this embodiment, the bottom of the beverage container is assured of being elevated above the ground when it is placed in cannister placement area of the holder.

In a third further embodiment, the beverage container holder includes an insulating material surrounding the beverage canister support area. The insulating material may be placed over the outside or in the inside of the hedge and vertical support system, for instance. This insulating material would perform a similar function as the insulating beverage wraps well known in the art.

In another further embodiment, the vertical support system is shaped as a continuous cone. In this embodiment, the ground-penetrating portion of the vertical support system may include the tip of the cone or may include only a partial cone, not including the tip. Such a configuration may be particularly suitable for soft or loose earth.

In another embodiment, the vertical support system portion connecting the hedge portion and the base portion is relatively cylindrical such that the beverage cannister area is formed by a cup-like structure.

In a still further embodiment, the beverage container holder is configured so that a beverage container does not extend over the beverage canister support area and the hedge includes a lid attached thereto for protecting the beverage from outside elements, such as sand, dirt and the like. Preferably, the lid is pivotally or hingedly connected to the hedge at one part thereof and removably engageable to another part of the hedge.

In another embodiment, the lower portion of each upstanding support is not directly connected to the upper portion of the upstanding support, i.e., that portion that defines at least part of the canister support area. In this embodiment, the lower portion is connected to the base at a first set of locations and the upper portion extends upward from the base from a second set of locations on the base.

While this invention has been described with reference to an illustrative embodiment and with reference to other embodiments not shown, it will be understood that this description shall not be construed in a limiting sense. Rather, various changes and modifications can be made to the described embodiments without departing from the true spirit and scope of the invention, as defined by the following claims. Furthermore, it will be appreciated that any such changes and modifications would be recognized by those skilled in the art as an equivalent to one element or more of the following claims, and shall be covered by such claims to the fullest extent permitted by law.

What is claimed is:

1. A beverage container holder comprising:

a vertical support system;

a base connected to said vertical support system for supporting a beverage container;

said vertical support system including a first upstanding support member having a top, a bottom, a first portion extending inwardly from said top to said base, and a second portion adapted for insertion into the ground extending vertically from said base to said bottom; and said vertical support system including a second upstanding support member having a top, a bottom, a first portion extending inwardly from said top to said base, and a second portion adapted for insertion into the ground extending vertically from said base to said bottom.

2. The beverage container holder of claim 1 further comprising:

a hedge connected to said second structure for further defining said canister placement area.

3. The beverage container holder of claim 2 wherein said hedge consists of looped band circumscribing an upper portion of said canister placement area.

4. The beverage container holder of claim 1 wherein said first structure of said vertical support system is a piercing device selected from the group consisting of:

(a) a plurality of prongs
(b) a plurality of pegs
(c) a plurality of shears
(d) a hollowed conical section
(e) a plurality of pins
(f) a plurality of spades, and
(g) a plurality of triangular segments.

5. The beverage container holder of claim 1 wherein said canister placement area is configured for receiving a canister selected from the group consisting of:

(a) can
(b) bottle
(c) cup
(d) jug
(e) jar
(f) glass
(g) goblet.

6. The beverage container holder of claim 1 wherein said base is comprised of two intermeshed rectangular sections intersecting at right angles at the center of the holder.

7. The beverage container holder of claim 1 wherein said beverage container holder is portable.

8. The beverage container holder of claim 1 wherein said beverage container holder includes a top portion and a bottom portion and said top portion is wider than said bottom portion to permit a second similarly designed beverage container holder to be stacked therein.

9. A beverage container holder comprising:

a first upstanding support;

a second upstanding support;

a third upstanding support;

a fourth upstanding support;

a beverage support connected to said first upstanding support, said second upstanding support, said third upstanding support, and said fourth upstanding support;

a hedge spaced from said beverage support and connected to said first upstanding support, said upstanding support, said third upstanding support, and said fourth upstanding support;

said first upstanding support member having a top, a bottom, a first portion extending inwardly from said top to said base, and a second portion adapted for insertion into the ground extending vertically from said base to said bottom;

said second upstanding support member having a top, a bottom, a first portion extending inwardly from said top to said base, and a second portion adapted for insertion into the ground extending vertically from said base to said bottom;

said third upstanding support member having a top, a bottom, a first portion extending inwardly from said top to said base, and a second portion adapted for insertion into the ground extending vertically from said base to said bottom; and said fourth upstanding support member having a top, a bottom, a first portion extending inwardly from said top to said base, and a second portion adapted for insertion into the ground extending vertically from said base to said bottom.

10. The beverage container holder of claim 9 wherein said beverage container includes a top portion and a bottom portion and said top portion is wider than said bottom portion to permit a second similarly designed beverage container holder to be stacked therein.

11. The beverage container holder of claim 9 wherein said hedge comprises a looped band.

12. The beverage container holder of claim 9 wherein said beverage container holder is configured for receiving a canister selected from the group consisting of:

(a) can
(b) bottle
(c) cup
(d) jug
(e) jar
(f) glass
(g) goblet.

13. The beverage container holder of claim 9 wherein said beverage support is comprised of two intermeshed rectangular sections intersecting at right angles at the center of the holder.

14. The beverage container holder of claim 9 wherein said beverage container holder is portable.

15. The beverage container holder of claim 1 wherein said first upstanding support includes a piercing device selected from the group consisting of:

(a) a prong (b) a peg (c) a shear (d) a pin (e) a spade, and (f) a triangular segment.

16. The beverage container holder of claim 9 wherein said beverage container holder has a height of about four and three-quarters inches.

17. The beverage container holder of claim 16 wherein said hedge has a width of about four inches.

18. A beverage container holder comprising:

a first upstanding support having a top portion, a mid portion and a bottom portion defining a leg for said holder for insertion into the ground;

a second upstanding support having a top portion, a mid portion and a bottom portion defining a leg for said holder;

a third upstanding support having a top portion, a mid portion and a bottom portion defining a leg for said holder;

a fourth upstanding support having a top portion, a mid portion and a bottom portion defining a leg for said holder;

a base for supporting a canister connected to said first, second, third and fourth upstanding supports at the mid portions of said first, second third and fourth upstanding supports;

a hedge comprising a looped band connected to said first, second, third and fourth upstanding support at the top portions of said first, second, third and fourth upstanding supports;

said top portions of said first, second, third and fourth upstanding support being further apart than said mid portions of said first, second, third and fourth upstanding supports; and said first, second, third and fourth upstanding support members extending vertically from said mid portions to said bottom portions.

19. The beverage container holder of claim 18 wherein said holder is portable.

20. The beverage container holder of claim 18 wherein said holder is constructed of plastic.

* * * * *